US005468124A

United States Patent [19]

Chen

[11] Patent Number: 5,468,124

[45] Date of Patent: Nov. 21, 1995

[54] PORTABLE ELECTRIC FAN

[76] Inventor: Guey-Shin Chen, 58, Ma Yuan West St., Taichung, Taiwan

[21] Appl. No.: 272,844

[22] Filed: Jul. 11, 1994

[51] Int. Cl.[6] ..... F04D 25/08

[52] U.S. Cl. ..... 416/63; 416/170 R; 416/149; 416/246; 415/129; 417/411; 417/234

[58] Field of Search ..... 416/63, 170 R, 416/246, 148, 149; 415/129, 121.3; 417/411, 234

[56] References Cited

U.S. PATENT DOCUMENTS

| | | | |
|---|---|---|---|
| 1,713,946 | 5/1929 | Buckley | 415/129 |
| 2,582,572 | 1/1952 | Tulk | 416/63 |
| 4,193,209 | 3/1980 | Lovison et al. | 416/63 |
| 5,304,035 | 4/1994 | Carter | 416/63 |

FOREIGN PATENT DOCUMENTS

| | | | |
|---|---|---|---|
| 859193 | 12/1952 | Germany | 416/246 |
| 2407760 | 8/1975 | Germany | 416/246 |
| 297794 | 12/1988 | Japan | 416/246 |
| 83884 | 3/1989 | Japan | 416/170 R |
| 142295 | 6/1989 | Japan | 416/170 R |

*Primary Examiner*—Edward K. Look
*Assistant Examiner*—James A. Larson

[57] ABSTRACT

A portable electric fan includes a rechargeable battery disposed in the bottom portion of a housing for storing and for supplying electric power. An opening is formed in the front portion of the housing for receiving a fan device, the fan device includes two shafts rotatably secured to the housing and each having a number of notches formed in the outer peripheral portion. Two resilient devices are engaged with the notches of the shafts so as to retain the fan device in suitable positions.

2 Claims, 1 Drawing Sheet

PORTABLE ELECTRIC FAN

BACKGROUND OF THE INVENTION

1. Field of the Invention

The present invention relates to an electric fan, and more particularly to a portable electric fan.

2. Description of the Prior Art

Typical electric fans are suitable for use indoors and are neither good for outdoor use nor for use in a vehicle. For example, no electric fans may be used for camping, sightseeing, watching games.

The present invention has arisen to mitigate and/or obviate the afore-described disadvantages of the conventional electric fans.

SUMMARY OF THE INVENTION

The primary objective of the present invention is to provide a portable electric fan which can be easily used anywhere.

In accordance with one aspect of the invention, there is provided a portable electric fan comprising a housing including a front portion and including a hollow interior having an upper portion, a middle portion and a lower portion, an opening formed in the front portion of the housing, a fan device engaged in the opening and including two shafts extended therefrom, the shafts each including an outer peripheral portion having a plurality of notches formed therein, means for rotatably securing the shafts to the housing so as to allow the fan device to rotate about the shafts, the securing means including a resilient means for engaging with the notches of the shafts so as to retain the fan device in suitable positions, at least one battery disposed in the lower portion of the hollow interior of the housing for energizing the fan device, an electric board and a socket disposed in the middle portion of the hollow interior of the housing, at least one rod secured in the upper portion of the hollow interior of the housing, and a strap means engaged with the rod for carrying the electric fan.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
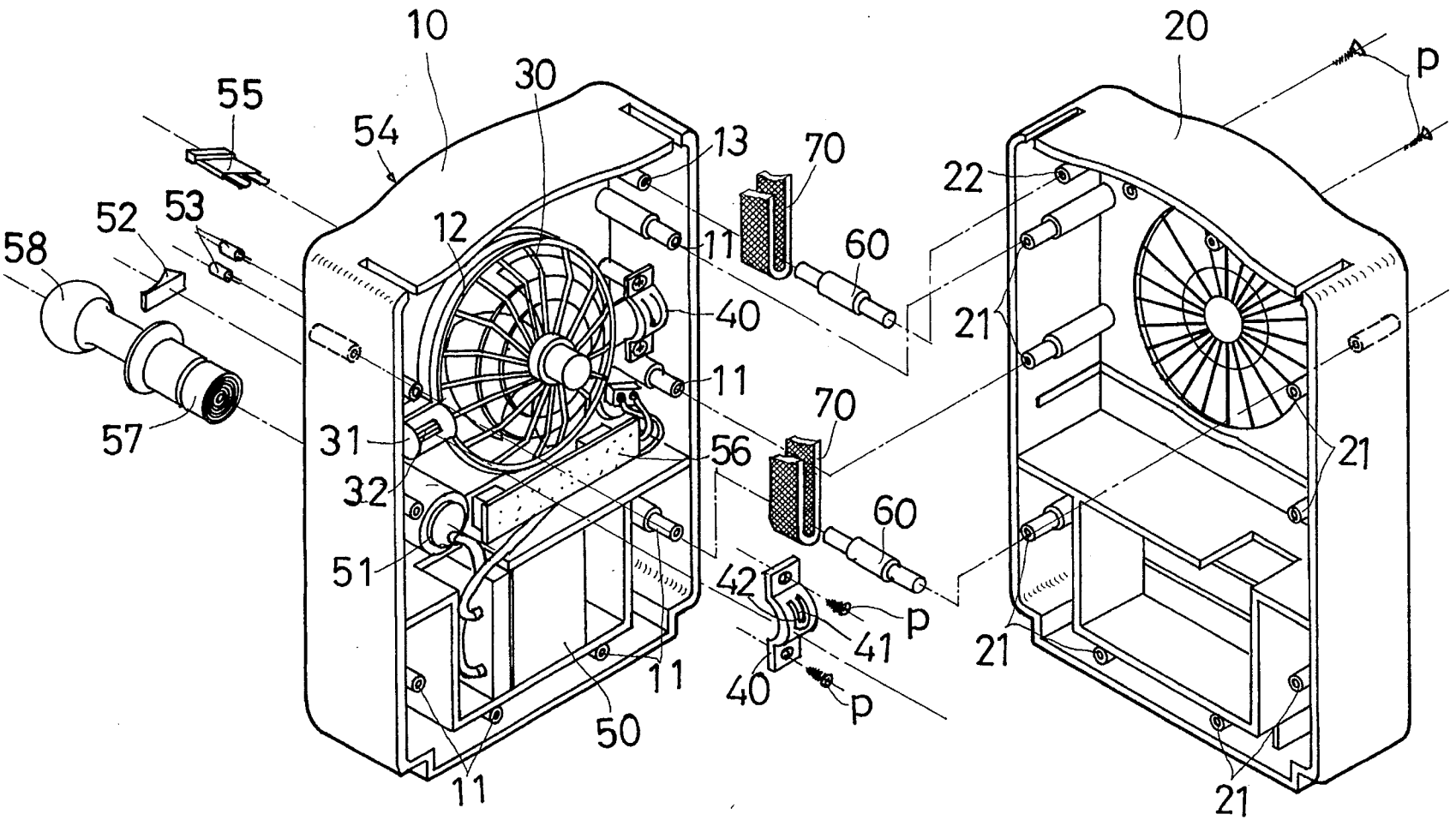
FIG. 1 is an exploded view of a portable electric fan in accordance with the present invention.

Referring to FIG. 1, a portable electric fan in accordance with the present invention comprises a front housing 10 and a rear housing 20 fixed together by screws P. The two housings 10, 20 each includes a number of stubs 11, 21 for engaging with the screws P so as to secure the two housings 10, 20 together. The front housing 10 includes an opening 12 formed therein for engaging with a fan device 30. The fan device 30 includes two shafts 31 extended laterally outward therefrom, each of the shafts 31 includes a number of notches 32 formed in the outer peripheral portion thereof. Two fastening devices 40 are secured to the front housing 10 by screws P which are inserted and screwed into the corresponding studs 11 and secures the shafts 33 so as to rotatably support the shafts 31 in place such that the fan device 30 is rotatable about the axes of the shafts 31. Each of the fastening devices 40 includes a resilient member 41 in the middle portion of having a projection 42 formed in the free end portion thereof for check the upper rotating of the notches 32 of the shafts 31 slightly so as to position the fan device 30 at suitable angular positions. After the shafts 31 are rotated upwardly to the predetermined angular positions, the user can rotate the casing of the fan device 30 downwardly with one hand. Thus the fan device 30, the shafts 31 and the corresponding notches 32 can be rotated manually by the user. Optionally, the fan device 30 can be manually rotated to a predetermined angular position upwardly or downwardly by the user.

A rechargeable battery 50 is disposed in the bottom portion of the front housing 10. A socket 51 is disposed in the middle portion of the front housing 10 for engaging with electric appliances, such as light equipment, portable phone, radio, small television, and cigarette igniter 57, etc. A directional indicator 58 may be secured to the cigarette igniter 57 for indicating directions. A switch knob 52 is secured to the front housing 10 for controlling the electric fan, two lights 53 are disposed in the front housing 10 for indicating electric power, a safety fuse 55 is engaged in the front housing 10, and an electric board 56 is disposed in the middle portion of the housing 10. Another socket may further be provided on the front portion of the front housing 10 for connecting to an electric power source so as to recharge the rechargeable battery 50. Two rods 60 have end portions engaged in four hubs 13, 22 formed in the housings 10, 20 respectively, a strap device 70 may engage with the rods 60 for carrying the electric fan.

Accordingly, the portable electric fan in accordance with the present invention includes a rechargeable battery which can be recharged for providing suitable electric power so as to energize the electric fan. The electric fan can be used anywhere.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A portable electric fan comprising:

a front housing and a rear housing matching each other;

a plurality of screws;

each of said front and rear housings having a plurality of stubs engaged with said screws to secure said front and rear housings together;

a fan device having two shafts extending outward therefrom, and each of said shafts having a plurality of notches formed transversely in an outer peripheral portion thereof;

an opening being formed in said front housing to match said fan device;

two fastening devices secured to said shafts respectively with said screws which are inserted and screwed into said stubs to support said shafts;

at least a battery being disposed in a lower portion of a hollow interior between said front and rear housings to provide electric energy for said fan device;

an electric board and a socket being disposed in a middle portion of said hollow interior between said front and rear housings;

at least a rod being disposed in an upper portion of said hollow interior between said front and rear housings; and a strap device being engaged with said rod to carry said electric fan;

wherein said fan device is rotated about the axes of said shafts and is manually rotated to a predetermined angular position upwardly and downwardly by a user.

2. A portable electric fan as claimed in claim 1, wherein each said fastening device has a resilient member formed in a middle portion of said fastening device, and wherein each said resilient member checks each of said corresponding notches of said shafts.

* * * * *